United States Patent [19]

Knapp et al.

[11] Patent Number: 4,563,086

[45] Date of Patent: Jan. 7, 1986

[54] COPY QUALITY MONITORING FOR MAGNETIC IMAGES

[75] Inventors: John F. Knapp, Fairport; Robert J. Gruber, Pittsford; Steven B. Bolte, Rochester, all of N.Y.

[73] Assignee: Xerox Corporation, Stamford, Conn.

[21] Appl. No.: 663,610

[22] Filed: Oct. 22, 1984

[51] Int. Cl.[4] ..... G03G 15/00

[52] U.S. Cl. ..... 355/14 D; 355/3 DD; 355/14 CH; 355/3 SH; 118/688; 118/689; 118/712

[58] Field of Search ..... 355/3 D, 14 D, 14 CH, 355/3 CH, 14 SH, 3 SH, 3 DR, 14 R; 118/663, 665, 688, 712, 689; 430/39, 122

[56] References Cited

U.S. PATENT DOCUMENTS

| | | | |
|---|---|---|---|
| 3,348,521 | 10/1967 | Hawk | 118/665 |
| 3,453,984 | 7/1969 | Gerek | 118/665 |
| 3,674,532 | 7/1972 | Morse | 118/665 X |
| 3,858,514 | 1/1975 | Beebe et al. | 101/426 |
| 3,993,484 | 11/1976 | Rait et al. | 96/1.4 |
| 4,179,213 | 12/1979 | Queener | 118/665 X |
| 4,248,527 | 2/1981 | Akiyama et al. | 355/14 R |
| 4,273,843 | 6/1981 | Fujita et al. | 118/665 X |
| 4,312,589 | 1/1982 | Brannan et al. | 355/14 CH |
| 4,314,257 | 2/1982 | Tokunaga et al. | 355/3 DR X |
| 4,372,672 | 2/1983 | Pries | 355/14 R |

*Primary Examiner*—A. C. Prescott

*Attorney, Agent, or Firm*—H. Fleischer; J. E. Beck; R. Zibelli

[57] ABSTRACT

An electrophotographic printing machine in which a magnetic toner image is transferred to a copy sheet from a photoconductive member and fused thereto. The toner image fused to the copy sheet is magnetized and the intensity of the magnetic field generated by the toner image detected to provide a continuous indication of the quality of the toner image fused to the copy sheet.

12 Claims, 3 Drawing Figures

COPY QUALITY MONITORING FOR MAGNETIC IMAGES

This invention relates generally to an electrophotographic printing machine, and more particularly concerns an apparatus for monitoring the quality of a magnetic toner image fused to a copy sheet.

In general, the process of electrophotographic printing includes charging a photoconductive member to a substantially uniform potential to sensitize the surface thereof. The charged portion of the photoconductive surface is exposed to a light image of an original document being reproduced. Alternatively, a modulated light beam, i.e. a laser beam, may be utilized to discharge selected portions of the charged photoconductive surface to record the desired information thereon. In this way, an electrostatic latent image is recorded on the photoconductive surface which corresponds to the information desired to be reproduced. After recording the electrostatic latent image on the photoconductive member, the latent image is developed by bringing developer material into contact therewith. Generally, the developer material comprises toner particles adhering triboelectrically to carrier granules. The carrier granules are magnetic with the toner particles also being magnetic and generally having ferremagnetic particles encapsulated in a thermoplastic resin binder. The toner particles are attracted from the carrier granules to the latent image recorded on the photoconductive member. This forms a toner powder image on the photoconductive member which is subsequently transferred to a copy sheet. Finally, the copy sheet is heated to permanently affix the powder image thereto in image configuration.

Electrophotographic printing has been particularly useful in the commercial banking industry by reproducing checks or financial documents with magnetic ink, i.e. by fusing magnetic toner particles thereon. Each financial document has imprinted thereon encoded data in a magnetic ink character recognition (MICR) format. In addition, high speed processing of financial documents is simplified by imprinting magnetic ink bar codes in machine readable form thereon. The repeated processing of the financial documents and the high speed sorting thereof is greatly simplified by the reading of the encoded data by an MICR reader. Thus, encoded information on financial documents may be imprinted thereon with magnetic ink or toner. The information reproduced on the copy sheet with the magnetic particles may be subsequently read due to its magnetic characteristics. Hereinbefore, high speed electrophotographic printing machines have employed magnetic toner particles to develop the latent image. These toner particles have been subsequently transferred to the copy sheet and fused thereto. The resultant document may have the magnetic data imprinted thereon in MICR format which is subsequently read by an MICR reader and processed. Thus, while the utilization of magnetically encoded information on documents reproduced with magnetic particles is well known, this information has not been employed to control the processing machine or continuously sense the copy quality. In evaluating copy quality, it is necessary to determine whether the density of the information reproduced on the copy sheet corresponds to the desired density. Previously, light sensors have been used for that purpose. However, a light sensor loses sensitivity at high toner mass coverage and usually cannot prevent gross overdeveloped images. In future products, it will be necessary to control copy quality over a wide latitude in a reliable manner. The present invention provides such a technique. The following disclosures appear to be relevant.

U.S. Pat. No. 4,372,672
Patentee: Pries
Issued: Feb. 8, 1983

U.S. Pat. No. 4,312,589
Patentee: Brannan et al.
Issued: Jan. 26, 1982

U.S. Pat. No. 3,993,484
Patentee: Rait et al.
Issued: Nov. 23, 1976

U.S. Pat. No. 3,858,514
Patentee: Deede et al.
Issued: Jan. 7, 1975

The pertinent portions of the foregoing disclosures may be briefly summarized as follows:

Pries describes a light source which produces light rays that are reflected off a toned sample test area to a phototransistor. The toned sample may be on the photoconductor or copy paper. A circuit controls the density of the toned samples such that the reflectance ratio of the toned-to-untoned photoconductor remains constant. Density control is achieved by adjusting the toner concentration in the developer mix to maintain constant output copy density.

Brannan et al. discloses a light emitting diode which illuminates a toned patch and a clean area of a photoconductor. A photosensor detects the light reflected from the toned patch and clean area. The signal from the photosensor is processed and used to adjust charging of the photoconductor. When the photoconductors charge magnitude has been increased to at, or near, the working magnitude and the toned patch is of too low a density, additional toner is added to the developer.

Rait et al. describes an electrostatic latent image recorded on a tape that is developed with magnetic toner particles. A magnetic image corresponding to the electrostatic latent image is formed on the tape. The toner particles are transferred to a copy paper and fused thereto. The magnetic image may be re-used, or, it can be scanned and used to generate electrical images indicative of the information and the signals stored.

Deede et al. discloses a magnetically encoded master source document which is superimposed adjacent a transfer sheet. A magnetic toner is applied to the transfer sheet and selectively attracted thereto forming a magnetic toner image corresponding to the master source document. The toner image is then fused to the transfer sheet and machine read by a pick-up device which may be an optical or magnetic character recognition device. The signals from the pick-up device are transmitted to a computer.

In accordance with one aspect of the features of the present invention, there is provided an electrophotographic printing machine of the type in which a magnetic toner image is transferred to a copy sheet from a photoconductive member and fused thereto. Means are provided to magnitize the toner image fused to the copy sheet. Means are provided for detecting the intensity of the magnetic field generated by the toner image fused to the copy sheet with the magnetic field intensity being proportional to the ratio of the mass of toner particles to area of toner particles.

Pursuant to another aspect of the features of the present invention, there is provided an apparatus for monitoring the quality of the magnetic toner image fused to a copy sheet. Means are provided for magnetizing the toner image fused to the copy sheet. Means are provided to detect the intensity of the magnetic field generated by the toner image fused to the copy sheet with the magnetic field intensity being proportional to the ratio and the mass of toner particles to area of toner particles.

Other aspects of the present invention will become apparent as the following description proceeds and upon reference to the drawings, in which.

While the present invention will hereinafter be described in conjunction with a preferred embodiment thereof, it will be understood that it is not intended to limit the invention to that embodiment. On the contrary, it is intended to cover all alternatives, modifications, and equivalents as may be included within the spirit and scope of the invention as defined by the appended claims.

Figure 1:
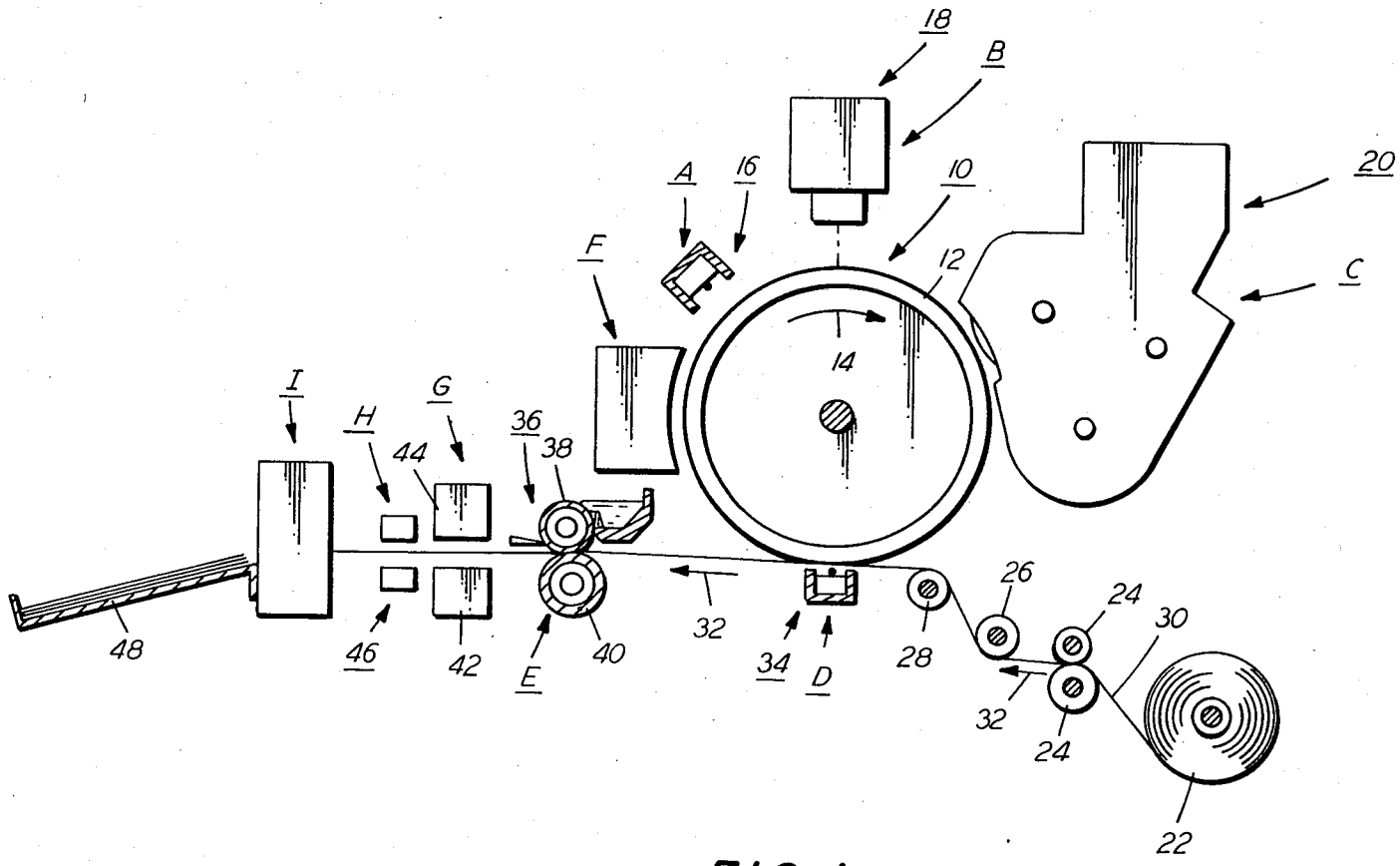
FIG. 1 is a schematic elevational view showing an illustrative electrophotographic printing machine incorporating the features of the present invention therein.

For a general understanding of the features of the present invention, reference is made to the drawings. In the drawings, like references numerals have been used throughout to designate identical elements. FIG. 1 schematically depicts the various components of an illustrative electrophotographic printing machine incorporating the apparatus of the present invention therein. It will become evident from the following discussion that this apparatus is equally well suited for use in a wide variety of electrostatographic printing machines and is not necessarily limited in its application to the particular embodiment depicted herein.

Inasmuch as the art of electrophotographic printing is well known, the various processing stations employed in the FIG. 1 printing machine will be shown hereinafter schematically and their operation described briefly with reference thereto.

As shown in FIG. 1, the illustrative electrophotographic printing machine employs a drum 10 having a photoconductive surface 12 adhering to a conductive substrate. Preferably, the photoconductive surface comprises a selenium alloy with the conductive substrate being an electrically grounded aluminum alloy. Drum 10 rotates in the direction of arrow 14 to advance successive portions of photoconductive surface 12 sequentially through the various processing stations disposed about the path of movement thereof.

Initially, a portion of photoconductive surface 12 passes through charging station A. At charging station A, a corona generating device, indicated generally by the reference numeral 16, charges photoconductive surface 12 to a relatively high, substantially uniform potential. Corona generating device 16 has a charging electrode and a conductive shield positioned adjacent photoconductive surface 12. A change in output of the power supply connected thereto causes corona generating device 16 to vary the charge voltage applied to photoconductive surface 12.

Next, the charged portion of photoconductive surface 12 is advanced through imaging station B. Imaging station B includes an exposure system, indicated generally by the reference numeral 18. In exposure system 18, an original document is positioned face down upon a transparent platen. Light rays reflected from the original document are transmitted through a lens to form a light image thereof. The light image is focused onto the charged portion of photoconductive surface 12 to selectively dissipate the charge thereon. This records an electrostatic latent image on photoconductive surface 12 which corresponds to the informational areas contained within the original document. One skilled in the art will appreciate that an optical system of the foregoing type need not be the only type of system employed to selectively dissipate the charge on the photoconductive surface. For example, a modulated light beam, such as the laser beam, may be used to irradiate the charged portion of the photoconductive surface to selectively dissipate the charge recording the desired information thereon. After the electrostatic latent image is recorded on the photoconductive surface, drum 10 advances the latent image to development station C.

At development station C, a magnetic brush development system, indicated generally by the reference numeral 20, transports a developer material of carrier granules having toner particles adhering triboelectrically thereto into contact with the electrostatic latent image. The toner particles are magnetic and are preferably made from a ferromagnetic material, such as magnetite embeded in a resin binder. The latent image attracts the toner particles forming a powder image on photoconductive surface 12 of drum 10. Development system 20 employs a developer roller which is electrically biased to a potential intermediate that of the background potential and that of the image potential recorded on photoconductive surface 12. As successive electrostatic latent images are developed, toner particles are depleted from the developer mixture. A toner particle dispenser is positioned in development system 20 to furnish additional toner particles to the developer mixture for subsequent use thereby.

One skilled in the art will appreciate that exposure system 18 may be arranged to record a sample electrostatic latent image on photoconductive surface 12 in the interdocument area. This sample electrostatic latent image is then developed with magnetic toner particles at development station C. In this way, a sample toner powder image may be formed on photoconductive surface 12 in the interdocument area.

After development, drum 10 advances the toner image to transfer station D. At transfer station D, a web of support material is moved into contact with the powder image. The web of support material 30 is advanced from a roll 22 by feed rolls 24 and tensioning rollers 26 and 28, respectively. As support material 30 advances, in the direction of arrow 32, it passes through transfer station D. Transfer station D includes a corona generating device 34 which sprays ions onto the backside of web 30. This attracts the magnetic toner powder image from photoconductive surface 12 to web 30. After transfer, web 30 continues to move in the direction of arrow 32 to fusing station E.

Fusing station E includes a fuser assembly, indicated generally by the reference numeral 36, which permanently affixes the transferred toner image to web 30. Preferably, fuser assembly 36 includes a heated fuser roller 38 and a back-up roller 40. Web 30 passes between fuser roller 38 and back-up roller 40 with the powder image contacting fuser roller 38. In this way, the powder image is permanently affixed to web 30. It should be noted that not only is the toner image permanently affixed to web 30 but, in addition thereto, the sample toner image transferred to web 30 in the interdocument region is also permanently affixed or fused thereto.

After the powder image is transferred from photoconductive surface 12 to web 30, drum 10 rotates the photoconductive surface to cleaning station F. At cleaning station F, a magnetic brush cleaning system removes the residual particles adhering to photoconductive surface 12. The magnetic brush cleaning system transports carrier granules closely adjacent to the photoconductive surface to attract residual toner particles adhering thereto.

After fusing, web 30 continues to move in the direction of arrow 32 to advance the fused toner image through magnetizing station G. Magnetizing station G includes a pair of magnetizing heads 42 and 44 disposed on opposed sides of web 30. Magnetizing heads 42 and 44 are substantially identical and each head includes a core around which is wound a coil connected by leads to a source of magnetizing current. Thus, as web 30 advances the magnetic toner image and magnetic toner sample through magnetizing station G, the toner particles become magnetized generating a magnetic field. The intensity of the magnetic field is proportional to the toner mass per area on the web.

As web 30 continues to advance in the direction of arrow 32, it passes through read station H. Read station H includes a magnetic transducer, indicated generally by the reference numeral 46, which may be a single gap magnetic read head or other magnetic transducer known to those skilled in the art. Transducer 46 is energized by the magnetic field generated from the toner powder image and the sampled toner image fused to web 30. The output from transducer 46 is transmitted to a logic network. The foregoing will be described in greater detail in reference to FIG. 2.

Web 30 continues to move in the direction of arrow 32 and the fused toner image deposited thereon passes through cutting station I. Cutting station I cuts the web into copy sheets. Each sheet then advances to catch tray 48 for subsequent removal from the printing machine by the operator. The sample toner image formed in the interdocument region is separated from the cut sheet and discarded.

Figure 2:
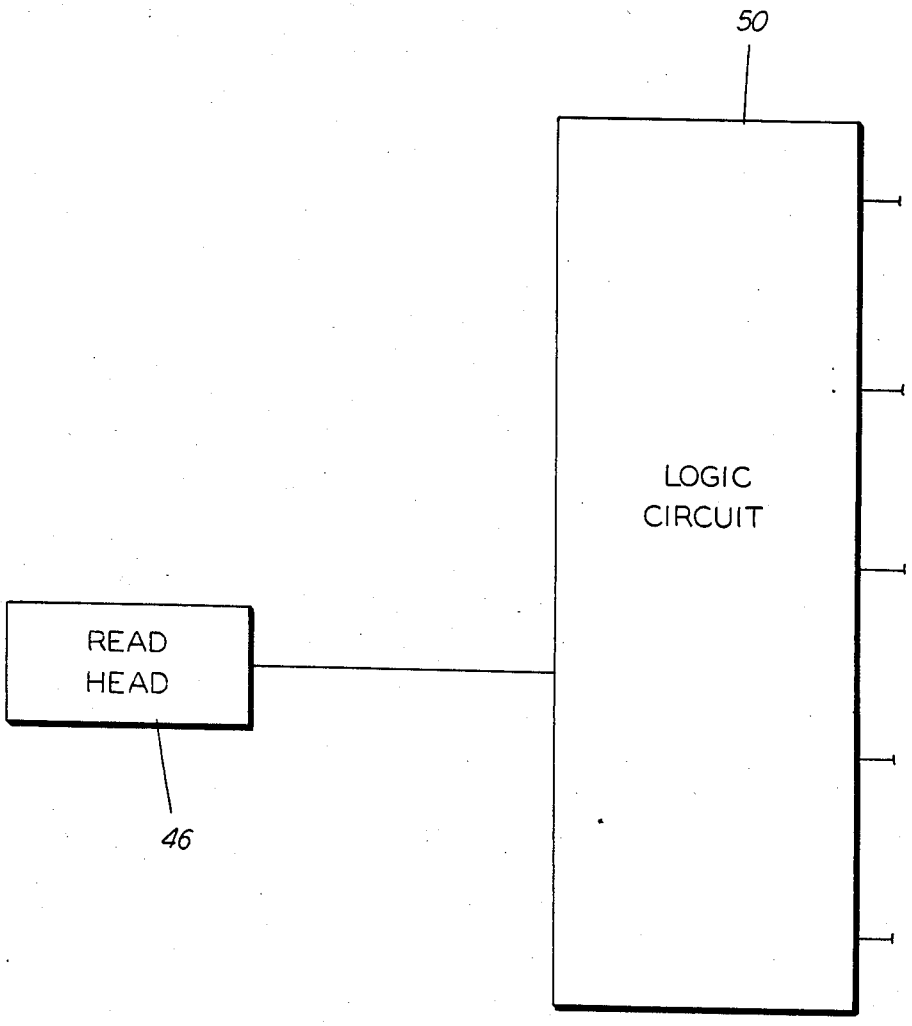
FIG. 2 is a schematic diagram illustrating the control scheme employed in the FIG. 1 printing machine.

Referring now to FIG. 2, the magnetic remnants in the toner powder image fused to the web induce a voltage in read head 46 proportional to the magnitite mass on web 30. Read head 46 transmitts a signal to logic circuit 50. Logic circuit 50 compares the magnetically derived signal from read head 46 with a reference to generate a control signal. The control signal is proportional to the difference between the desired toner mass per area on web 30 and the measured toner mass per area of copy. Thus, the control signal, is, in fact, an error signal. This error signal is also a measure of the quality of the toner image fused to web 30. Hence, logic circuit 50 provides a continuous monitor of the quality of the toner image fused to web 30. When the error signal exceeds a preselected limit, it regulates various processing stations within the printing machine. The error signal from logic circuit 50 may be used to control charging, exposing, development, transfer, and dispensing of toner particles into the developer mixture. The foregoing will be described in greater detail with reference to FIG. 3.

Figure 3:
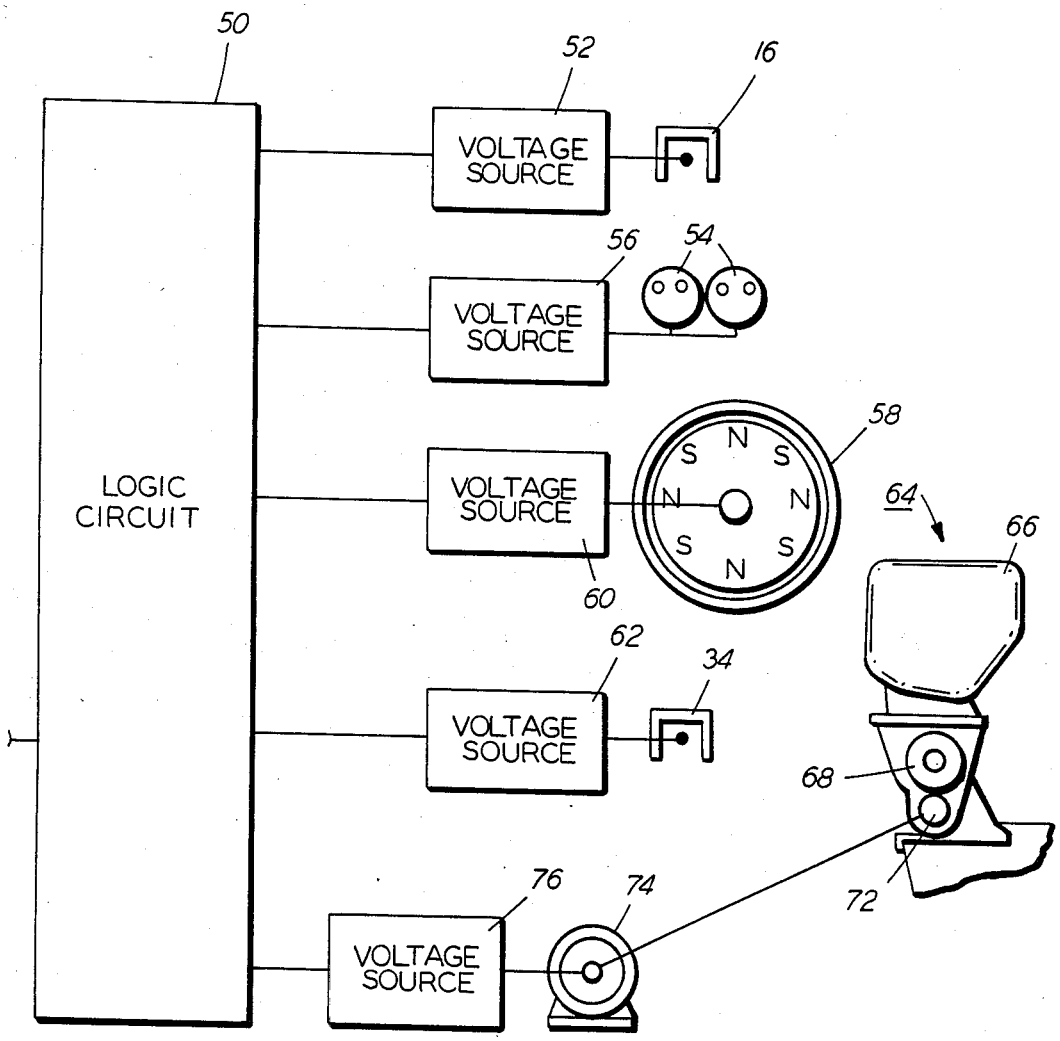
FIG. 3 is a schematic diagram depicting the regulation of the various processing stations in the FIG. 1 printing machine.

Turning now to FIG. 3, there is shown the various processing stations within the electrophotographic printing machine that are controlled by the error signals from logic circuit 50. As shown thereat, logic circuit 50 transmits an error signal to voltage source 52. The error signal from logic circuit 52 regulates the output voltage from voltage source 52 so as to control corona generator 16. The output from corona generator 16 is thus regulated to vary as a function of the error signal from logic circuit 50 which, in turn, is a function of the quality of the toner image fused to the copy sheet, i.e. the toner mass per area on the copy sheet. Thus, corona generating device 16 produces a charge sufficient to maintain photoconductive surface 12 at a preselected potential, irrespective of variations in conditions.

Logic circuit 50 is also in communication with scan lamps 54 of exposure system 18. The output signal from logic circuit 50 is an error signal, which varies as a function of the intensity of the magnetic field of the toner image. The error signal corresponds to the requisite change in lamp voltage in order to have photoconductive surface 12 discharged to the desired level. This error signal is utilized to regulate voltage source 56 exciting scan lamps 54. Preferably, lamps 54 are excited at a nominal value optimized for exposure. As an error signal is produced, the voltage supply to the lamp varies as a function thereof about a nominal value to compensate for deviations in conditions.

Logic circuit 50 also regulates developer roller 58 of development system 20. Developer roller 58 includes a non-magnetic tubular member journalled for rotation. A magnetic member is disposed interiorly of and spaced from the tubular member. Voltage source 60 electrically biases the tubular member of developer roller 58 to a suitable polarity and magnitude. This selected electrical bias is intermediate the potential of the electrostatic latent image and the background regions of photoconductive surface 12. The error signal produced by logic circuit 50 is employed to regulate the output voltage from voltage source 60. In this way, the electrical bias applied to the tubular member of developer roller 58 is controlled to optimize development.

Logic circuit 50 also transmits an error signal to voltage source 62 which is coupled to corona generator 34. The error signal from logic circuit 50 regulates the output voltage from voltage source 62 so as to control corona generator 34. The output from corona generator 34 is regulated to vary as a function of the error signal from the logic circuit. Thus, corona generating device 34 produces a charge sufficient to transfer the toner particles from photoconductive surface 12 to web 30 irrespective of variations in conditions.

As toner particles are depleted from the developer mixture during the development process, additional toner particles are furnished thereto. Logic circuit 50 also controls the furnishing of additional toner particles to the development system. The toner dispenser, indicated generally by the reference numeral 64, is disposed in development station 20. Toner dispenser 64 includes a container 66 storing a supply of toner particles therein. A foam roller 68 is disposed in a sump 70 coupled to container 66 for dispensing toner particles into auger 72. Motor 74 rotates auger 72 so as to advance the toner particles from sump 70 into the chamber of the developer housing. The toner particles, when dispensed into the chamber of the developer housing, mix with the developer mixture to maintain the developer mixture at the desired concentration level. Energization of motor 74 is controlled by voltage source 76. Voltage source 76 is connected to logic circuit 50. The intensity of the magnetic field measured by read head 46 is proportional to the toner mass per area of the copy sheet. The signal from the read head is compared to a reference so as to produce an error signal for controlling the addition of toner particles to the development system. This error signal is then utilized to control voltage source 76 which, in turn, energizes motor 74. In this way, additional toner particles are furnished to the development system as required by conditions within the printing machine.

By way of example, logic circuit 50 includes a suitable discriminator circuit for comparing a reference with the signal from read head 46. The discriminator circuit may utilize a control switch adapted to turn on and effectively lock in an electrical output signal having a magnitude related to the input reference and the input signal corresponding to the toner mass per area fused to the copy sheet. The resultant error signal is then utilized to control the voltage sources associated with the corona generating device used for charging and transfer, scan lamps, developer roller and toner dispenser. In this way, the various processing stations within the printing machine are controlled to optimize copy quality as a function of the toner mass per area.

One skilled in the art will appreciate that the sample toner image may be used as an indication of copy quality and/or to control the various processing stations within the printing machine, as well as, or in addition to the toner powder image.

In recapitulation, it is evident that the apparatus of the present invention controls the various processing stations within the electrophotographic printing machine as well as providing a continuous monitor of the quality of the toner image fused to the copy sheet. The toner image fused to the copy sheet is magnetic. The magnetic toner image is magnetized and the intensity of the magnetic field induced therein read. A signal is generated corresponding to the intensity of the magnetic field produced by the toner image fused to the copy sheet. This signal is compared to a reference and provides a continuous monitor of the quality of the toner image fused to the copy sheet and may be employed as a control signal for regulating the various processing stations within the printing machine so as to provide continuous adjustment to optimize copy quality.

It is, therefore, apparent that there has been provided, in accordance with the present invention, an apparatus for continuously monitoring the quality of the toner image fused to the copy sheet and controlling the various processing stations within the printing machine as a function thereof. This apparatus fully satisfies the aims and advantages hereinbefore set forth. While this invention has been described in conjunction with a specific embodiment thereof, it is evident that many alternatives, modifications, and variations will be apparent to those skilled in the art. Accordingly, it is intended to cover all such alternatives, modifications, and variations as fall within the spirit and broad scope of the appended claims.

We claim:

1. An electrophotographic printing machine of the type in which a magnetic toner image is transferred to a copy sheet from a photoconductive member and fused thereto, including:

means for magnetizing the toner image fused to the copy sheet; and means for detecting the intensity of the magnetic field generated by the toner image fused to the copy sheet with the magnetic field intensity being proportional to the ratio of the mass of toner particles to area of toner particles on the copy sheet.

2. A printing machine according to claim 1, further including means for comparing the intensity of the magnetic field detected by said detecting means and being generated by the toner image to a reference for providing a continuous monitor of the quality of the toner image fused to the copy sheet.

3. A printing machine according to claim 2, wherein the copy sheet is a continuous web of paper.

4. A printing machine according to claim 3, further including means for forming a magnetic toner sample on the web of copy paper in the region between adjacent toner images, said magnetizing means magnetizing the toner sample and said detecting means sensing the intensity of the magnetic field generated by the toner sample.

5. A printing machine according to claim 4, further including means, responsive to the intensity of the magnetic field sensed by said sensing means, for generating a control signal to regulate a processing station of the printing machine.

6. A printing machine according to claim 5, wherein said generating means controls the processing station charging the photoconductive member.

7. A printing machine according to claim 5, wherein said generating means controls the processing station exposing the charged portion of the photoconductive member.

8. A printing machine according to claim 5, wherein said generating means controls the processing station discharging toner particles into the developer mixture.

9. A printing machine according to claim 5, wherein said generating means controls the processing station depositing toner particles onto the photoconductive member to form the toner image thereon.

10. A printing machine according to claim 5, wherein said generating means controls the processing station transferring the toner image from the photoconductive member to the copy sheet.

11. An apparatus for monitoring the quality of a magnetic toner image fused to a copy sheet, including:

mean for magnetizing the toner image fused to the copy sheet; and means for detecting the intensity of the magnetic field generated by the toner image fused to the copy sheet with the magnetic field intensity being proportional to the ratio of the mass of toner particles to the area of toner particles on the copy sheet.

12. An apparatus according to claim 11, further including means for comparing the intensity of the magnetic field detected by said detecting means and being generated by the toner image to a reference for providing a continuous monitor of the quality of the toner image fused to the copy sheet.

* * * * *